United States Patent [19]

Waters et al.

[11] Patent Number: 4,808,125

[45] Date of Patent: Feb. 28, 1989

[54] CONNECTOR ASSEMBLY WITH DIECAST HOUSING AND DRAWN SHELL

[75] Inventors: Mark H. Waters, Harrisburg; Charles Reynolds, Mechanicsburg; John A. Root; Robert N. Whiteman, Jr., both of Middletown, all of Pa.

[73] Assignee: AMP Incorporated, Harrisburg, Pa.

[21] Appl. No.: 90,563

[22] Filed: Aug. 31, 1987

[51] Int. Cl.[4] ..... H01R 13/658

[52] U.S. Cl. ..... 439/607

[58] Field of Search ..... 439/92, 108, 607–610

[56] References Cited

U.S. PATENT DOCUMENTS

| | | | |
|---|---|---|---|
| Re. 32,502 | 9/1987 | Kumar | 439/92 |
| 4,506,937 | 3/1985 | Cosmos et al. | 339/14 R |
| 4,512,618 | 4/1985 | Kumar | 339/14 R |
| 4,601,527 | 7/1986 | Lemke | 439/608 |
| 4,701,139 | 10/1987 | Good et al. | 439/607 |

FOREIGN PATENT DOCUMENTS

| | | |
|---|---|---|
| 0189288 | 7/1986 | European Pat. Off. . |
| 123837 | 4/1984 | Japan . |
| 917995 | 3/1960 | United Kingdom . |
| 2098412 | 11/1982 | United Kingdom . |

*Primary Examiner*—John McQuade

*Attorney, Agent, or Firm*—David L. Smith

[57] ABSTRACT

An electrical connector asembly (10) for mounting to a planar surface (96) has an elongate electrically conductive diecast housing (12) having an aperture (42) therein. A drawn shell (14) having an aperture therein is received in the diecast housing aperture (42). Barbs (60, 62) engage the peripheral edge (50) of flange (46), center drawn shell (14) and assure electrical continuity between drawn shell (14) and diecast housing (12). A burr relief pocket (70) in diecast housing (12) accommodates any burrs (68) from barbs (60, 62) such that flange (46) seats against housing surface (48). A thermoplastic header insert (16) having terminal receiving passages (78) with terminals (82) secured therein is received in and secured in the drawn shell aperture. Insert (16) engages barbs (60, 62) in an interference fit and is centered and partially retained thereby. A portion of rib (104) of diecast housing (12) is formed over lower edge (102) of header insert (16) to secure drawn shell (14) and header insert (16) in diecast housing (12).

18 Claims, 5 Drawing Sheets

CONNECTOR ASSEMBLY WITH DIECAST HOUSING AND DRAWN SHELL

BACKGROUND OF THE INVENTION

This invention relates to an electrical connector assembly and in particular to an electrical connector assembly having a cast housing and drawn shell to provide shielding and a path to ground for the shielding.

Prior art subminiature D connectors typically had a drawn shell with an integral groundstrap to provide shielding and a conductive path to ground. The drawn shell surrounded a thermoplastic housing in which contact terminals were secured and provided shielding therefor, as disclosed in U.S. Pat. No. 4,679,883.

As electronics have become more densely packed, so too have the interconnections to and between electronic assemblies. A widely accepted spacing of contacts has become 0.50 inch lateral and 0.100 inch vertical in high density connectors. To assure that high density connectors remain mated, latches on the cable assembly connector grip the housing of a board or panel mounted connector. Since plastic would fail under the grippping action of repeated mating and unmating, high density connectors have incorporated cast metal housings. Providing shielding of terminal contacts in cast housings has thus been complicated.

SUMMARY OF THE INVENTION

In accordance with the invention, an electrical connector assembly for mounting to a planar surface has an elongate electrically conductive diecast housing having an aperture therein. A drawn shell having an aperture therein is received in the diecast housing aperture such that the drawn shell and diecast housing are electrically commoned. A thermoplastic insert having terminal receiving passages with terminals secured therein is received and secured in the drawn shell aperture. the drawn shell provides shielding for the terminals and the diecast housing provides additional shielding and a path to ground from the drawn shell. The thermoplastic insert is secured in the diecast housing by forming a portion of the diecast housing over the aperture therein thus preventing removal of the thermoplastic insert.

DESCRIPTION OF THE PREFERRED EMBODIMENT

Figure 1:
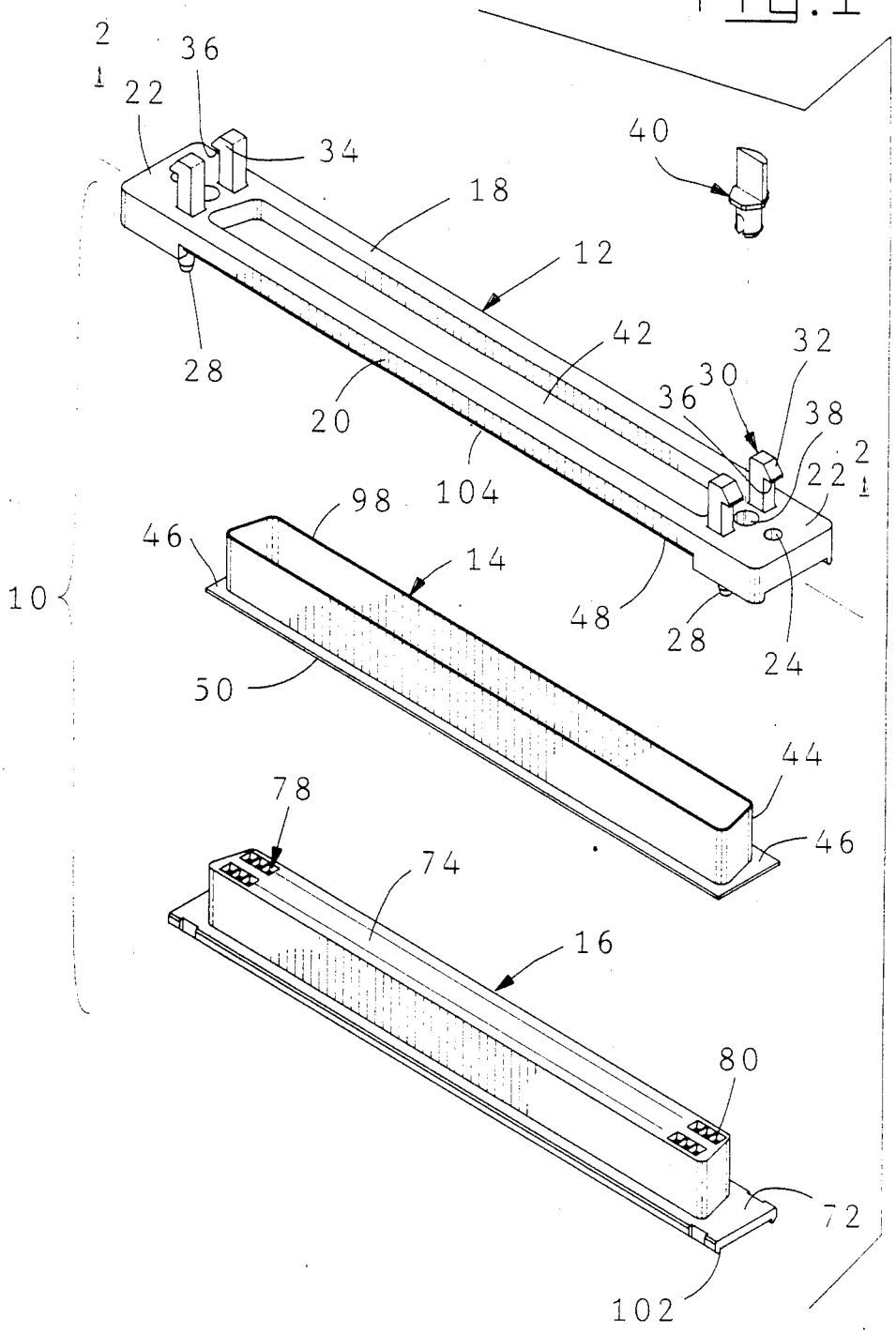
FIG. 1 is an exploded perspective view of a connector assembly in accordance with the present invention.

FIG. 1 depicts an exploded perspective view of an electrical connector assembly 10 in accordance with the present invention. Electrical connector assembly 10 is comprised of diecast housing 12, drawn shell 14 and header insert 16.

Diecast housing 12 may be fabricated of any known electrically conductive material then plated such as with tin; a magnesium alloy, aluminum alloy or zinc alloy is preferred. Die cast housing 12 is elongate, having upper surface 18, lower surface 20 and flanges 22 at opposite ends thereof. Flanges 22 have mounting apertures 24, which may be threaded, extending from upper surface 18 to lower surface 20 for securing connector assembly 10 to a planar surface such as a panel or printed circuit board. Connector assembly 10 may also be secured by other known means such as posts 28 being soldered in corresponding apertures in a printed circuit board. Mounting feet 26 extend from lower surface 20 to space lower surface 20 a predetermined distance from a printed circuit board on which connector assembly 10 is mounted so that flux may be removed subsequent to soldering.

Latching members 30 extend from upper surface 18 for securing a mated complementary connector (not shown) to connector assembly 10. Upon mating with a complementary connector, latch means on the complementary connector engage and ramp over tapered surface 32 of latch ear 34 thence snap under and engage latching shoulder 36. Key receiving recess or aperture 38 extends from upper surface 18 and is adapted to receive and retain a key 40.

In this manner the latch means secure a mated complementary connector to diecast housing 12 which is mounted directly on the planar surface with any resulting forces on the latch means that are transmitted to latching member 30 not subjecting the contacts 82 to any strain.

Intermediate flanges 22, aperture 42 extends through diecast housing 12 from upper surface 18 to lower surface 20. Electrically conductive shroud 44 has a similar outer profile to aperture 42 and is received therein in an interference fit to assure electrical conductivity between diecast housing 12 and drawn shell 14. In a preferred embodiment, the profile of shroud 44 is a subminiature D which provides polarization of connector assembly 10 during mating with a complementary connector.

Shroud 44 of drawn shell 14 extends forwardly of a substantially rectangular flange 46. Upon insertion of drawn shell 14 into aperture 42 from the rear, that is from the side of lower surface 20, flange 46 prevents drawns shell 14 from passing through aperture 42 by engaging surface 48 which extends around the periphery of aperture 42. Seating flange 46 against surface 48 assures that shroud 44 protrudes forward of upper surface 18 a predetermined appropriate distance.

Figure 2:
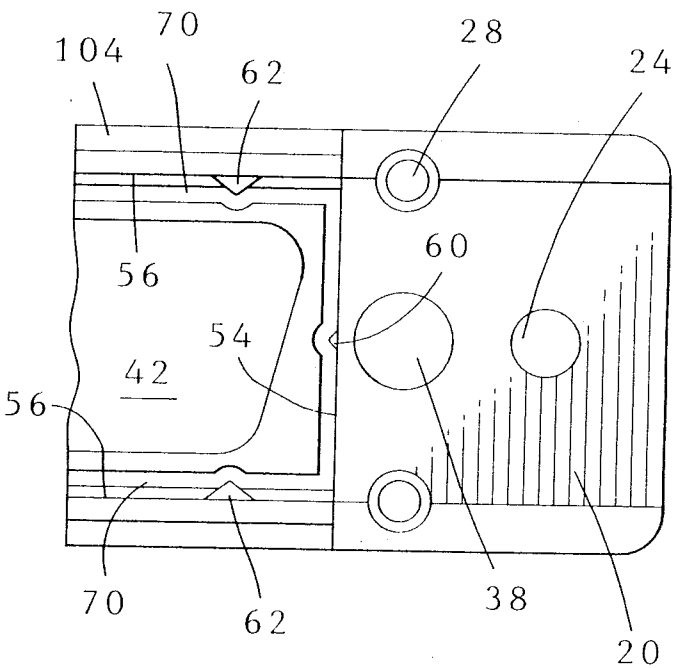
FIG. 2 is a rear view of the diecast housing shown in FIG. 1.
Figure 2:
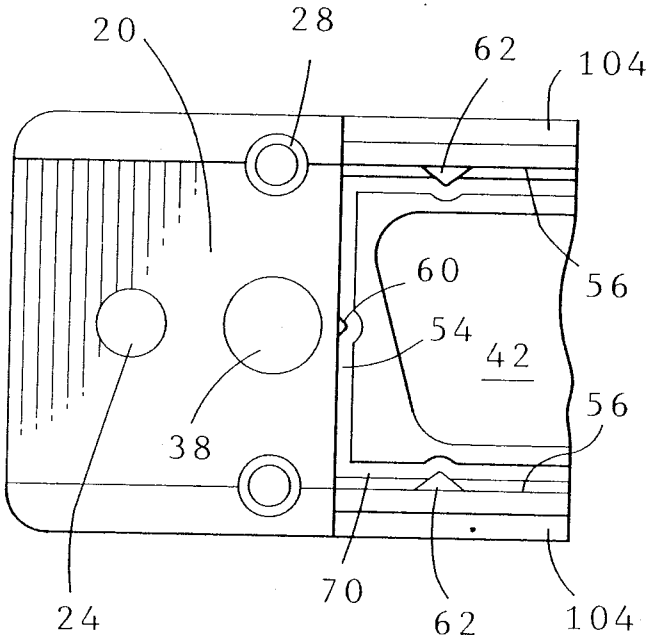
Figure 3:
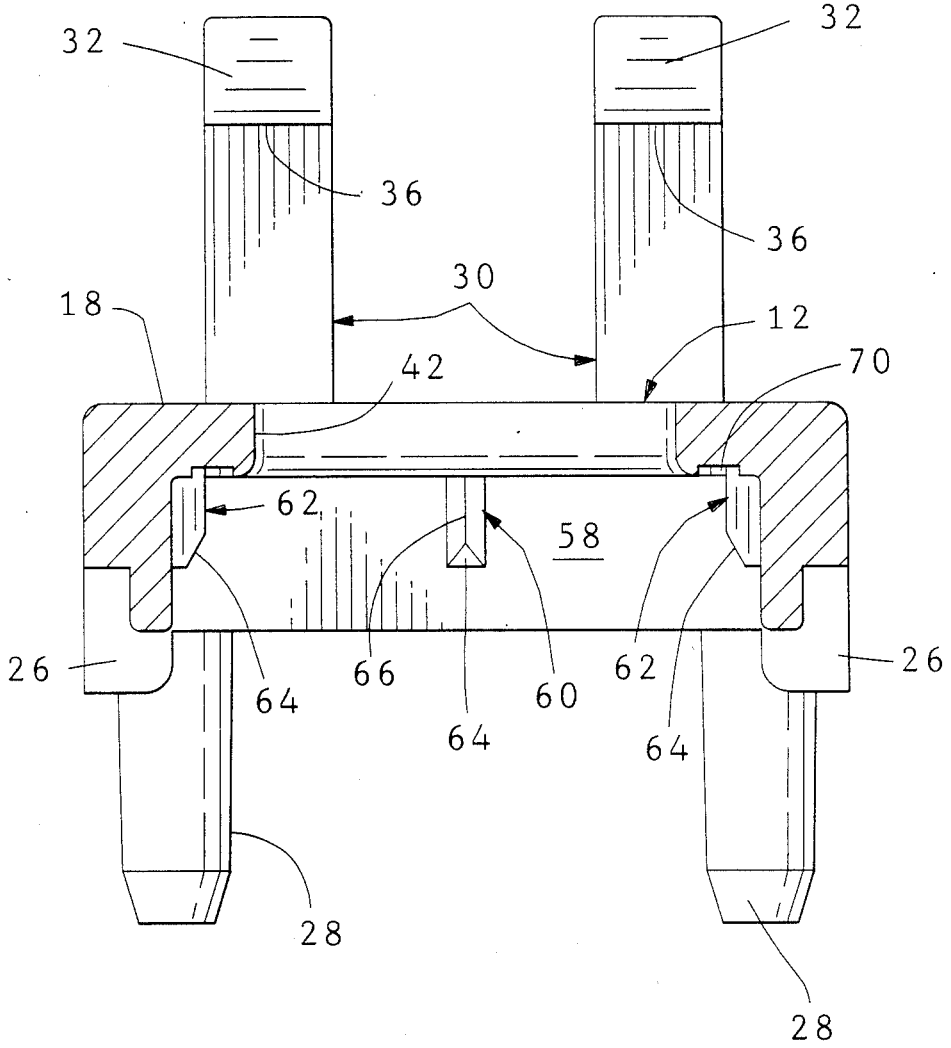
FIG. 3 is a cross sectional view of the diecast housing shown in FIG. 1.
Figure 4:
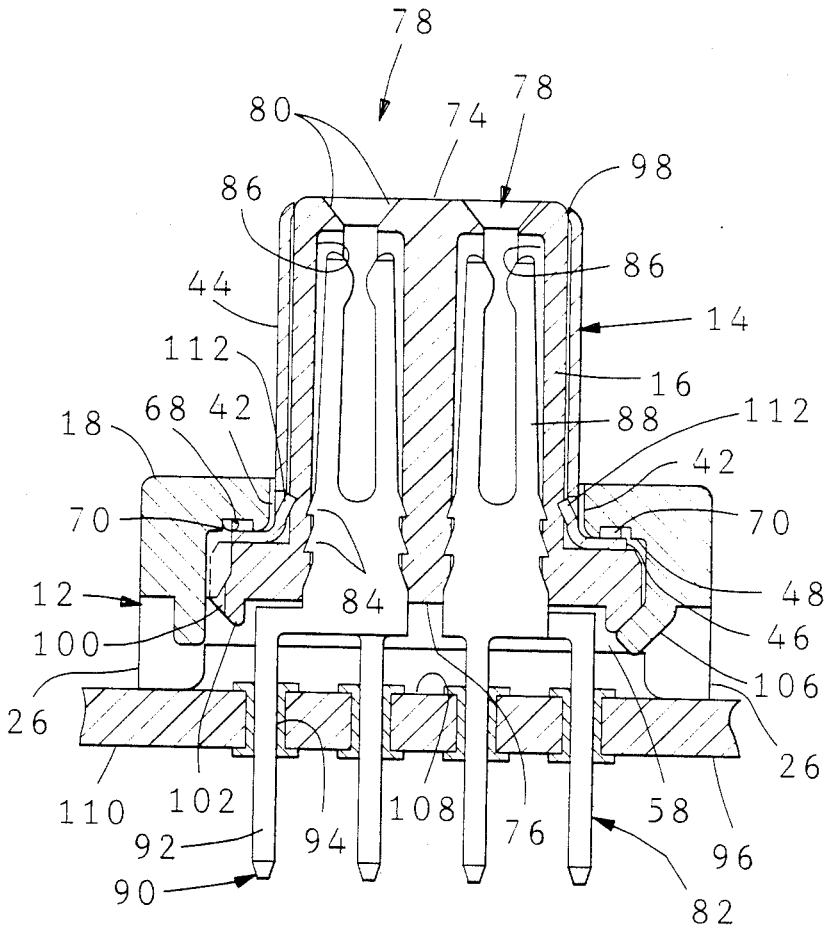
FIG. 4 is a cross sectional view of the connector assembly shown in FIG. 1.

Also upon insertion of drawn shell 14 into aperture 42 the peripheral edge 50 of flange 46 engages shell-to-shield grounding barbs on the interior endwalls 54 and sidewalls 56 of cavity 58. As best seen in FIGS. 2, 3 and 4, shell-to-shield grounding barbs 60 extend inward from endwalls 54 into cavity 58; shell-to-shield grounding barbs 62 extend inward from sidewalls 56 into caivty 58. Grounding barbs 60 and 62 provide an interference fit with the peripheral edge 50 that assures electrical continuity between diecast housing 12 and drawn shell 14.

Barbs 60, 62 extend from surface 48 along endwalls 54 and sidewalls 56 protruding into cavity 58 to interfere with peripheral edge 50. Tapered surface 64 provides a tapered lead in for flange 46 during insertion. In a preferred embodiment barbs 60, 62 have the shape of a triangular prism with apex 66 providing interference with peripheral edge 50. Alternatively, barbs 60, 62 could be located on drawn shell 14 and engage diecast housing 12 such as along endwalls 54 or sidewall 56.

Barbs 60, 62 may be strategically located to center drawn shell 14 in aperture 42 of diecast housing 12 such as by two barbs on one wall and a centered barb on the opposing wall, or by a pair of opposed barbs. FIG. 2 shows a pair of opposed barbs 60 on endwalls 54 that center drawn shell 14 laterally in aperture 42 and two pairs of opposed barbs 62 on sidewalls 56 that each center drawn shell 14 vertically in aperture 42.

Figure 6:
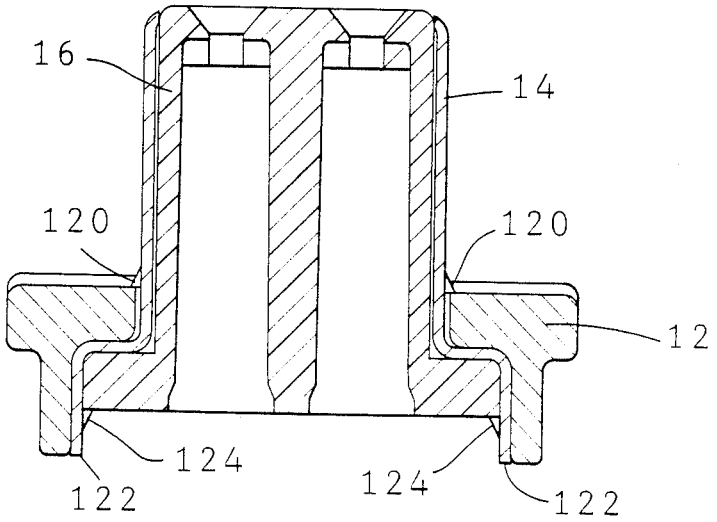
FIG. 6 shows a cross-sectional view of an alternate embodiment connector assembly.

An alternate embodiment diecast housing 12 and drawn shell 14 combination is shown in FIG. 6 wherein tapered barbs or protrusions 120 on drawn shell 14 pass through aperture 42 thence snap outwardly to secure drawn shell 14 in diecast housing 12. This alternate embodiment necessitates inserting drawn shell 14 into aperture 42 before inserting header insert 16 into drawn shell 14. Upon inserting header insert into drawn shell 14, flange member 122 flexes outwardly and housing 16 flexes inwardly to permit header insert 16 to pass beyond barbs or protrusions 124 which secures header insert 16 within drawn shell 14. Barbs or protrusions 120, 124 may be stamped or formed in drawn shell 14 during or after the drawing process. Barbs 120 also assist in establishing electrical continuity between diecast housing 12 and drawn shell 14.

As drawn shell 14 is received in aperture 42, a burr 68 may form as peripheral edge 50 passes over apex 66 of barbs 60, 62. To assure that flange 46 seats engaging surface 48, a burr relief pocket 70 is formed in surface 48 around the periphery of aperture 42 at least in the region of barbs 60, 62 to receive such a burr 68.

Header insert 16 is molded of thermoplastic and has an insert portion 74, adapted to be received in shroud 44, extending upwardly from integral peripheral flange 72. Insert portion 72 has a similar outer profile to the inside surface of an aperture in shroud 46 and is received therein. Insert 16 has mating face 74, opposed rear face 76 and a plurality of contact receiving passages 78 extending from mating face 74 such as extending between mating face 74 and rear face 76.

Contact receiving passages 78 typically have tapered lead-in surfaces 80 in mating face 74 to facilitate mating. Contacts 82, which are inserted from rear face 76, are secured in contact receiving passages 78 such as by barbs 84 that plow through the plastic forming sidewalls 86 with the plastic flowing around barbs 84. Contacts 82 have a mating portion 88 extending into contact receiving passages 78 where sidewalls 86 may provide an antioverstress function, and a mounting portion 90, typically solder posts 92, that extend beyond rear face 76 for mounting such as in apertures 94 in printed circuit board 96. Mounting portions 90 are then soldered to traces on the upper and lower surfaces, 108 and 110 respectively, of printed circuit board 96. As best seen in FIG. 4, mounting portion 90 of every other contact 82 may be axially offset from the mating portion 88 of the same contact 82 so as to provide a greater space between adjacent apertures 94 in printed circuit board 96.

Header insert 16 is inserted through cavity 58, mating face 74 first, to seat within drawn shell 14 with mating face 74 terminating proximate edge 98 of drawn shell 14. Flange 72 of header insert 16 engages flange 46 of drawn shell 14 to assure that flange 46 engages diecast housing 12 to provide electrical continuity between diecast housing 12 and drawn shell 14 and secure drawn shell 14 in position by clamping flange 46 between surface 48 of diecast housing 12 and flange 72 of header insert 16. Drawn shell 14 may include barb means to engage insert 16 and to secure insert 16 in shell 14. The barb means may take the form of a sheared, inwardly deflected tab 112 as shown in section in FIG. 4.

Barbs 60, 62 also provide a centering function and fit with header insert 16 to secure header insert 16 within drawn shell 14 and cavity 58 as sidewall 100 of flange 72 engage barbs 60, 62. Header insert 16 is further secured within diecast housing 12 by forming a portion of housing 12 subsequent to inserting header insert 16. The lower edge 102 of sidewall 100 is molded at an angle and the lower sidewalls of diecast housing 12 is fabricated with a rib 104. Rib 104 is formed over edge 102 at one or more locations forming diecast retention feature 106 as shown on the left side of FIG. 4 prior to being formed and on the right side of FIG. 4 subsequent to being formed. In a preferred embodiment, lower edge 102 is molded at a 45 degree angle thus requiring rib 104 to be formed over only 45 degrees. Ribs 104 when formed over provide a diecast retention feature 106 and are less likely to fail than if formed through a large angle such as 90 degrees.

Figure 5:
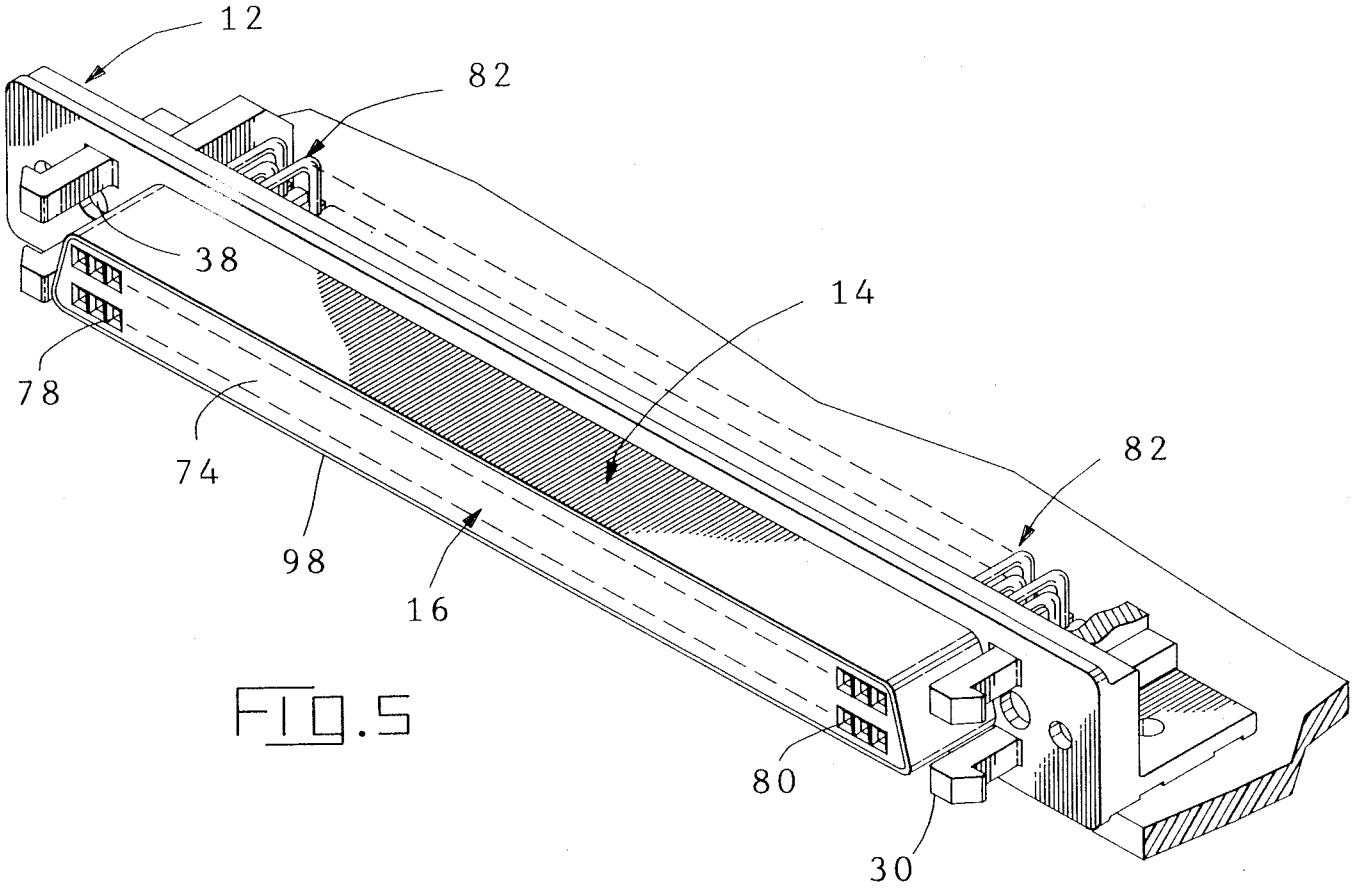
FIG. 5 is an alternate embodiment of the connector assembly showing a right angle connector.

FIG. 5 shows an alternate embodiment connector assembly 10 in which contacts 82 are formed with a 90 degree bend forming a connector in which the mating face is at a right angle with respect to the mounting face.

Although the connectors shown in the figures are for "through board" mounting where mounting portion 90 of contacts 82 pass through apertures 94 in printed circuit board 96, the invention is not limited thereto. The invention has application to surface mount technology where apertures 94 are eliminated and mounting portions 90 are soldered to traces only on the side of printed circuit board 96 on which connector assembly 10 is mounted.

Connector assembly 10 thus provides a combination of a drawn shell which is proven for shielding with a diecast housing that can be drilled and tapped thus minimizing hardware and providing a durable latching surface.

We claim:

1. An electrical connector assembly for mounting on a printed circuit board having a ground, said assembly having terminals for interconnecting with traces on the printed circuit board, comprising an electrically conductive diecast housing having an aperture therein;

a drawn shell having an aperture, said drawn shell adapted to be received in the diecast housing aperture and electrically commoned therewith;

a thermoplastic insert adapted to be received and secured in the drawn shell aperture, said insert having terminal receiving passages with terminals secured therein, said terminals having a mating portion secured in said insert and a mounting portion extending beyond said insert, said mounting portion adapted to interconnect with traces on the printed circuit board, whereby the shell provides shielding for the terminals with the diecast housing electrically commoned with the shell providing an electrical path to a ground on the printed circuit board.

2. An electrical connector assembly as recited in claim 1, wherein the drawn shell is adapted to be received in the diecast housing aperture in an interference fit.

3. An electrical connector assembly as recited in claim 1, wherein the terminals are straight posted.

4. An electrical connector assembly as recited in claim 1, wherein the terminals have a right angle bend therein.

5. An electrical connector assembly as recited in claim 1, wherein said shell comprises a flange and a shroud upstanding therefrom, said shroud having said apreture therein.

6. An electrical connector assembly as recited in claim 1 further comprising inwardly directed barb means in said diecast housing aperture for engaging said shell and for establishing electrical continuity therebetween.

7. An electrical connector assembly as recited in claim 1 wherein said insert is secured in said drawn shell aperture by forming a portion of said diecast housing over said diecast housing aperture.

8. An electrical connector assembly as recited in claim 1 further comprising outwardly directed barb means in said drawn shell for engaging the diecast housing and for establishing electrical continuity therebetween.

9. An electrical connector assembly as recited in claim 1 further comprising barb means in said drawn shell for engaging the insert and for securing the insert in the drawn shell.

10. An electrical connector assembly for mounting on a planar surface, comprising:

an electrically conductive diecast housing having an aperture therein, said aperture having inwardly protruding barb means;

a drawn shell having an aperture, said drawn shell adapted to be received in the diecast housing aperture in engagement with said barb means;

a thermoplastic insert adapted to be received and secured in the drawn shell aperture, said shell engaging said barb means in an inteference fit, said insert having terminal receiving passages with terminals secured therein, whereby the shell provides shielding for the terminals with the diecast housing providing an electrical path to a ground on the planar surface.

11. An electrical connector assembly as recited in claim 10 wherein said insert is secured in said drawn shell aperture by forming a portion of said diecast housing over said diecast housing aperture.

12. An electrical connector assembly as recited in claim 10 further comprising a burr relief channel in said diecast housing proximate said barb means, whereby upon insertion of the shell into the diecast housing aperture, any burr formed by the shell engaging the barb means is received in the burr relief channel thereby permitting the shell to seat against the diecast housing.

13. An electrical connector assembly as recited in claim 10 further comprising latch means extending from the diecast housing for securing a complementary connector to the electrical connector assembly.

14. An electrical connector assembly as recited in claim 10 wherein the drawn shell further comprises a flange, said flange being received between said insert and said diecast housing, whereby the insert is secured in said diecast housing with the flange of said shell trapped between the insert and the diecast housing with the flange in engagement with said diecast housing.

15. An electrical connector assembly as recited in claim 14 wherein said insert is secured in said drawn shell aperture by forming a portion of said diecast housing over said diecast aperture.

16. An electrical connector assembly as recited in claim 10 wherein the electrically conductive diecast housing is fabricated from an alloy from the group: magnesium, aluminum or zinc.

17. An electrical connector assembly for mounting on a planar surface, comprising:

an electrically conductive diecast housing having an aperture therein, said diecast housing having inwardly directed barb means in said aperture for engaging a drawn shell and for establishing electrical continuity therebetween;

a drawn shell having an apeture, said drawn shell adapted to be received in the diecast housing aperture and electrically commoned therewith;

a thermoplastic insert adapted to be received and secured in the drawn shell aperture, said insert having terminal receiving passages with terminals secured therein, whereby the shell provides shielding for the terminals with the diecast housing electrically commoned with the shell providing an electrical path to a ground on the planar surface.

18. An electrical connector assembly for mounting on a planar surface, comprising:

an electrically conductive diecast housing having an aperture therein;

a drawn shell having an aperture, said drawn shell adapted to be received in the diecast housing aperture, said drawn shell having outwardly directed barb means for engaging the diecast housing and for establishing electrical continuity therebetween;

a thermoplastic insert adapted to be received and secured in the drawn shell aperture, said insert having terminal receiving passages with terminals secured therein, whereby the shell provides shielding for the terminals with the diecast housing electrically commoned with the shell providing an electrical path to a ground on the planar surface.

* * * * *